US008870622B2

(12) United States Patent
Tsai

(10) Patent No.: US 8,870,622 B2
(45) Date of Patent: Oct. 28, 2014

(54) SPINNING TOP

(75) Inventor: Chao-Yang Tsai, Kaohsiung (TW)

(73) Assignee: Shyne Chi Enterprise Co. Ltd., Kaohsiung (TW)

( * ) Notice: Subject to any disclaimer, the term of this patent is extended or adjusted under 35 U.S.C. 154(b) by 249 days.

(21) Appl. No.: 13/221,401

(22) Filed: Aug. 30, 2011

(65) Prior Publication Data

US 2013/0052909 A1 Feb. 28, 2013

(51) Int. Cl.
*A63H 1/00* (2006.01)

(52) U.S. Cl.
USPC ..... 446/256

(58) Field of Classification Search
USPC ..... 446/256
See application file for complete search history.

(56) References Cited

U.S. PATENT DOCUMENTS

| | | | | |
|---|---|---|---|---|
| 808,918 | A | 1/1906 | Grattan | |
| 814,962 | A | 3/1906 | Irving | |
| 1,206,942 | A | 12/1916 | Swanstrom | |
| 2,111,180 | A | 3/1938 | Fessenmeyer | |
| 2,464,994 | A | 3/1949 | Roseen | |
| 2,619,769 | A * | 12/1952 | Gallaher | 446/69 |
| 2,739,415 | A | 3/1956 | Roberton et al. | |
| 3,093,926 | A | 3/1959 | Wright | |
| 3,018,584 | A | 1/1962 | Passariello | |
| 5,791,966 | A | 8/1998 | Capps et al. | |
| 6,270,391 | B1 | 8/2001 | Emilsson | |
| 6,364,734 | B1 | 4/2002 | Ng | |
| 6,666,743 | B2 * | 12/2003 | Polare et al. | 446/256 |
| 6,764,375 | B1 | 7/2004 | Hsu | |
| 2010/0120324 | A1 | 5/2010 | Goozner | |

FOREIGN PATENT DOCUMENTS

| | | |
|---|---|---|
| CN | 201524410 | 7/2010 |
| EP | 2106832 | 10/2009 |
| GB | 1181333 | 2/1970 |
| KR | 2020010011831 | 10/2001 |
| SG | 0080013 | 4/2001 |
| SU | 1794466 | 2/1993 |

OTHER PUBLICATIONS

Search Report Issued in European Counterpart Patent Application No. 11179478.0, Dated Apr. 26, 2012.
Examination Report Issued in New Zealand Counterpart Patent Application No. 594900, Dated Sep. 6, 2011.
Examination Report Issued in Ukrainian Counterpart Patent Application No. a201110408, Dated May 4, 2012.
Examination Report Issued in Ukrainian Counterpart Patent Application No. a201110408, Dated May 4, 2012 (English Translation).

* cited by examiner

*Primary Examiner* — Michael Dennis
(74) *Attorney, Agent, or Firm* — SmithAmundsen LLP; Kelly J. Smith; Dennis S. Schell

(57) ABSTRACT

A spinning top includes a main body tapering from a top end to a bottom end thereof and having a rotating tip end at the bottom end, and a plate body including a base portion connected to and covering the top end of the main body, an annular grip portion extending outwardly and radially from the base portion, and a top face defined by top surfaces of the base portion and the annular grip portion. The base portion has a central tapered groove tapering downwardly from the top face of the plate body. The rotating tip end has a diameter smaller than a smallest diameter of the central tapered groove.

12 Claims, 12 Drawing Sheets

SPINNING TOP

BACKGROUND OF THE INVENTION

1. Field of the Invention

This invention relates to a spinning top, and more particularly to a spinning top that can be spun for a prolonged period of time.

2. Description of the Related Art

Referring to FIG. 1, a conventional spinning top 1, as disclosed in Taiwanese Publication No. 200948447, includes a main body 11, and a shaft 12 projecting downward from the main body 11. In use, a cord 13 is wound around the main body 11, and is pulled at one end 131 thereof to spin the main body 11 and the shaft 12.

As shown in FIG. 1, the main body 11 of the conventional spinning top 1 has a simple configuration that tapers downward, and has no structure that can increase centrifugal force, so that the spinning time of the top 1 cannot be prolonged. Further, a top face of the main body 11 has a conical shape with a tip end facing upward, so that it is not possible to stack another spinning top to the conventional spinning top 1 while spinning.

SUMMARY OF THE INVENTION

Therefore, an object of the present invention is to provide a spinning top that is capable of overcoming the aforementioned drawbacks of the prior art.

According to this invention, a spinning top comprises a main body tapering from a top end to a bottom end thereof and having a rotating tip end at the bottom end, and a plate body including a base portion connected to and covering the top end of the main body, an annular grip portion extending outwardly and radially from the base portion, and a top face defined by top surfaces of the base portion and the annular grip portion. The base portion has a central tapered groove tapering downwardly from the top face of the plate body. The rotating tip end has a diameter smaller than a smallest diameter of the central tapered groove.

The advantage of this invention resides in that through the annular grip portion that extends outwardly and radially from the base portion, gripping of the spinning top can be facilitated, so that not only a greater throwing force can be imparted, but also the centrifugal force generated during spinning of the spinning top can be increased, thereby prolonging the spinning time of the spinning top. Further, through the presence of the central tapered groove, a second spinning top may be spun on the central tapered groove of a first spinning top. Hence, a plurality of spinning tops may be stacked on top of each other while spinning.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
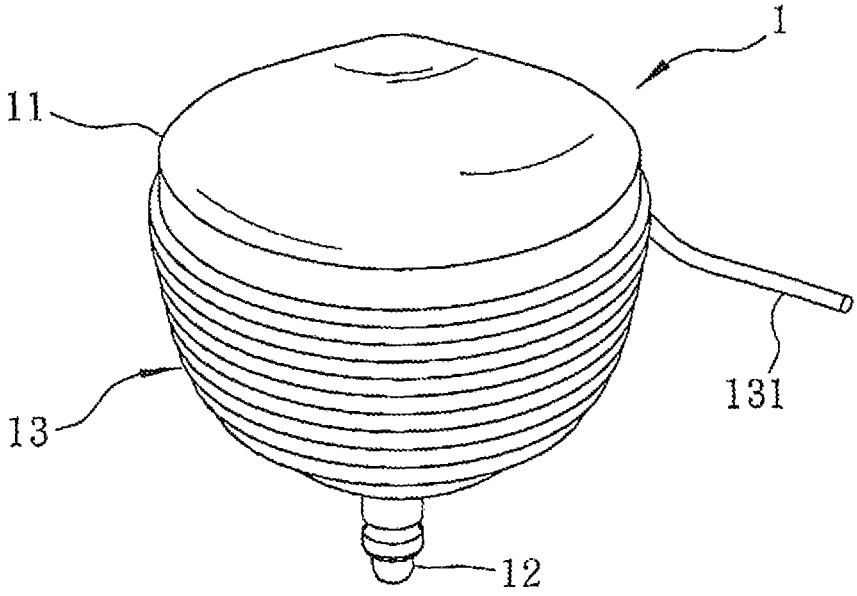
FIG. 1 PRIOR ART
FIG. 1 is a perspective view of a conventional spinning top disclosed in Taiwanese Publication No. 200948447.
Figure 2:
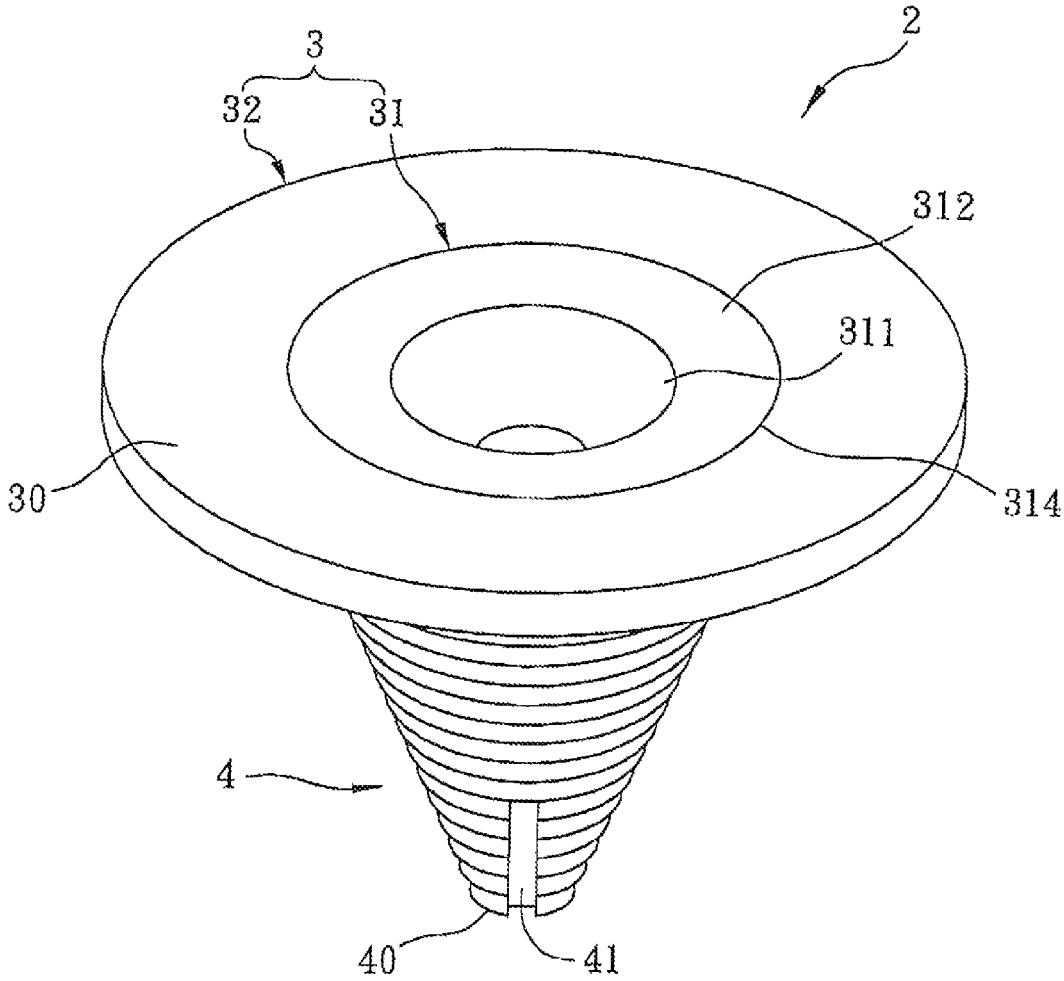
FIG. 2 is a perspective view of a spinning top according to the first preferred embodiment of this invention.
Figure 3:
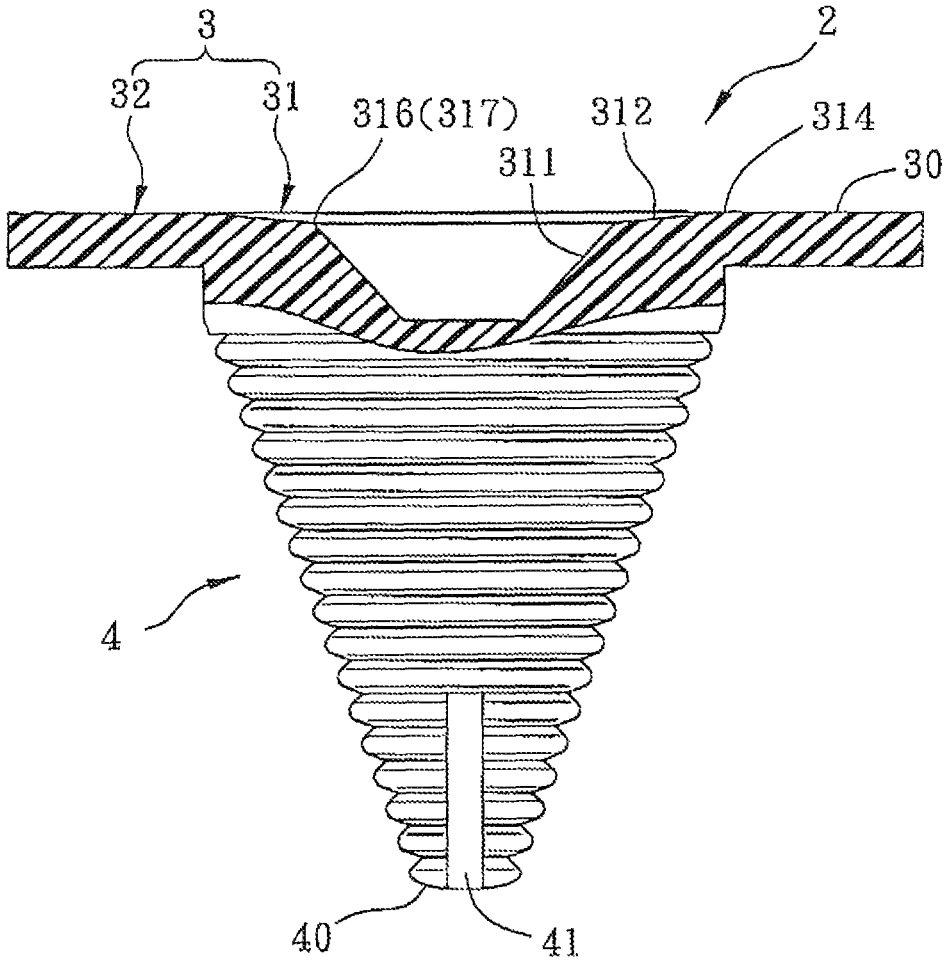
FIG. 3 is a partial sectional view of the first preferred embodiment.

Before the present invention is described in greater detail, it should be noted that the same reference numerals have been used to denote like elements throughout the specification.

Referring to FIGS. 2 to 5, a spinning top 2 according to the first preferred embodiment of this invention is shown to comprise a plate body 3 and a main body 4.

The plate body 3 includes a base portion 31, an annular grip portion 32 extending outwardly and radially from an outer periphery of the base portion 31, and a top face 30 defined by top surfaces of the base portion 31 and the grip portion 32. The base portion 31 has a central tapered groove 311 tapering downwardly from the top face 30 of the plate body 3, and a slope area 312 that surrounds the central tapered groove 311 and that has an upper periphery 314 directly connected to the top face 30 of the plate body 3, and a lower periphery 316 connected directly to a top periphery 317 of the central tapered groove 311. The slope area 312 is tapered from the upper periphery 314 to the lower periphery 316.

The main body 4 tapers gradually from a top end to a bottom end, and has a rotating tip end 40 at the bottom end thereof. In this embodiment, the main body 4 is connected integrally as one piece to the plate body 3 such that the base portion 31 of the plate body 3 covers the top end of the main body 4. The rotating tip 40 has a diameter smaller than a smallest diameter of the central tapered groove 311. The main body 4 further has a retaining flute 41 extending upwardly from the rotating tip end 40.

Figure 4:
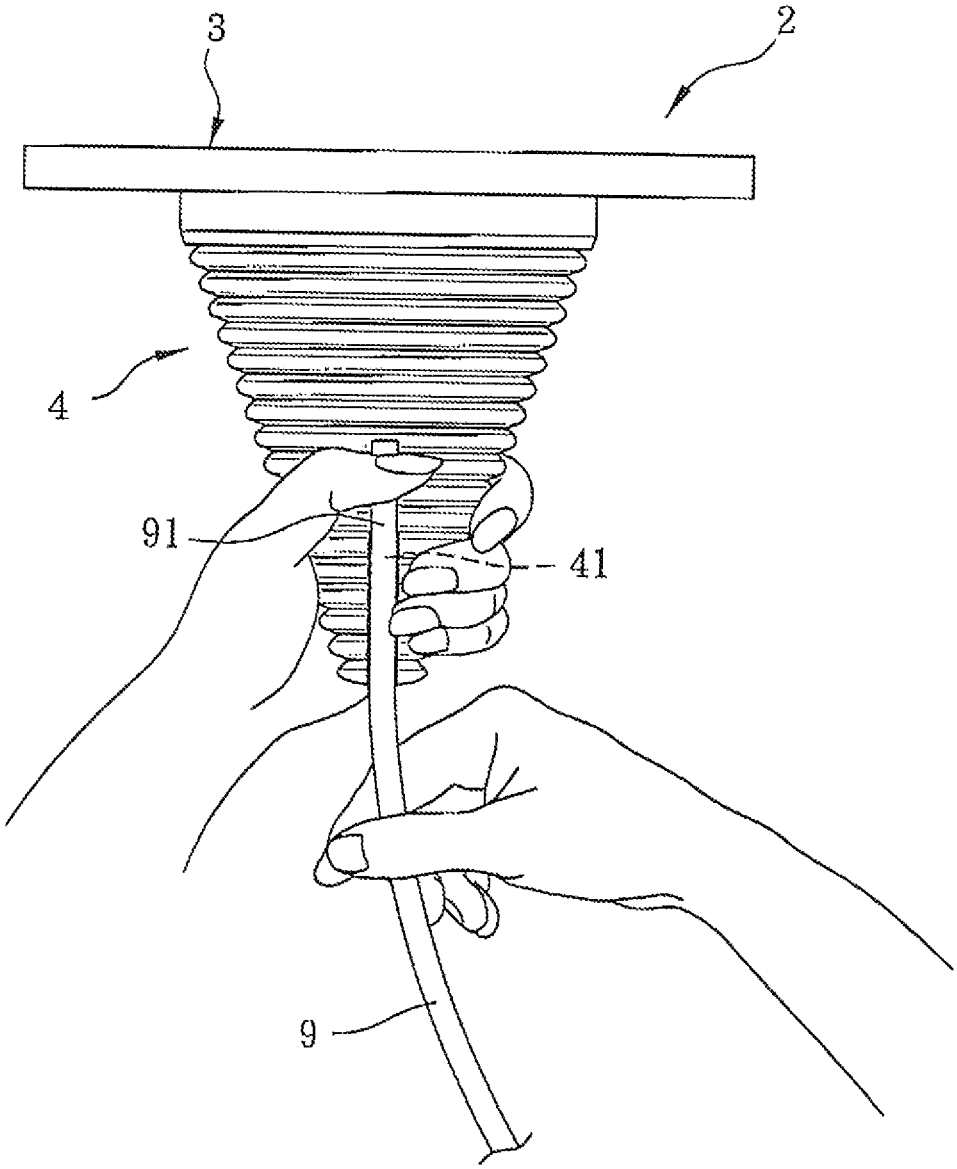
FIG. 4 illustrates how one end of a pull cord is placed in a retaining flute of a main body of the spinning top of the first preferred embodiment.
Figure 5:
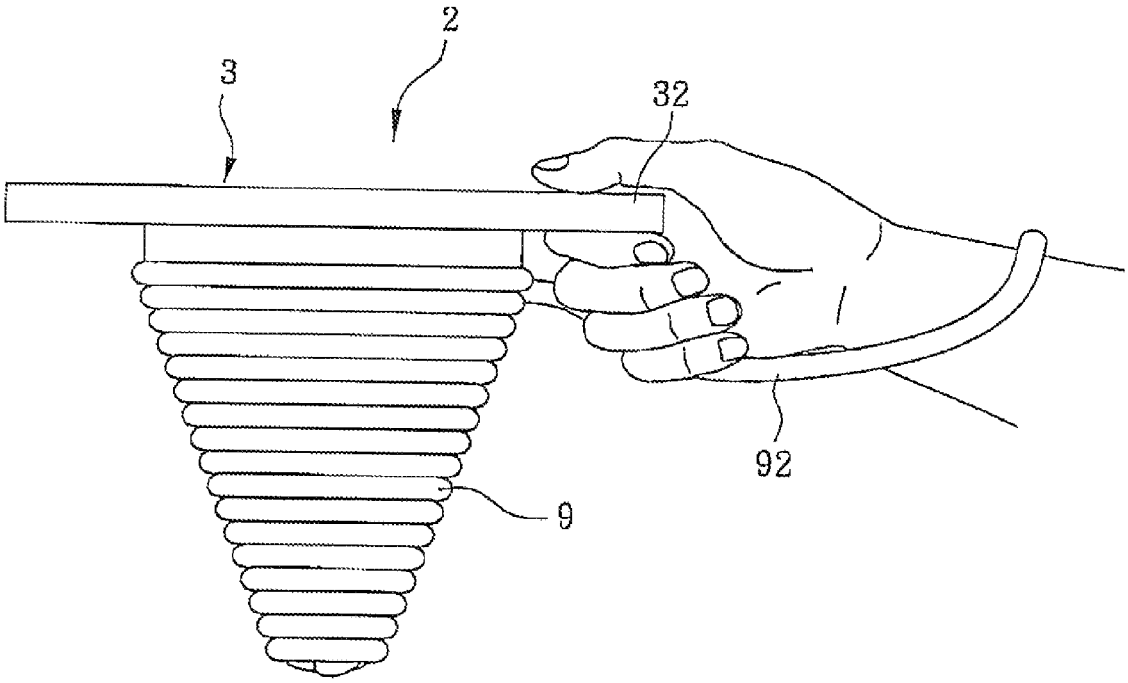
FIG. 5 illustrates how to operate the spinning top of the first preferred embodiment.

With reference to FIGS. 4 and 5, one end 91 of a pull cord 900 is first placed in the retaining flute 41, after which the remaining portion of the pull cord 900 is wound around the main body 4 of the spinning top 2 in a bottom-to-top direction covering the end 91 of the pull cord 900. A free end 92 of the pull cord 900 and the grip portion 32 of the plate body 3 are then simultaneously gripped by the user. Finally, the spinning top 2 is thrown out like a flying saucer to rotate on its rotating tip end 40 while pulling back the pull cord 900.

In the spinning top 2 of this invention, the grip portion 32 not only extends outwardly and radially from the base portion 31, but also extends outwardly of the main body 4. Hence, aside from the design of the spinning top 2 being relatively novel and special, the grip portion 32 can also facilitate gripping of the spinning top 2 by the user so that a greater throwing force can be imparted to the spinning top 2, and the centrifugal force generated during spinning of the spinning top 2 can be simultaneously increased. Thus, the spinning time of the spinning top 2 can be prolonged.

Figure 6:
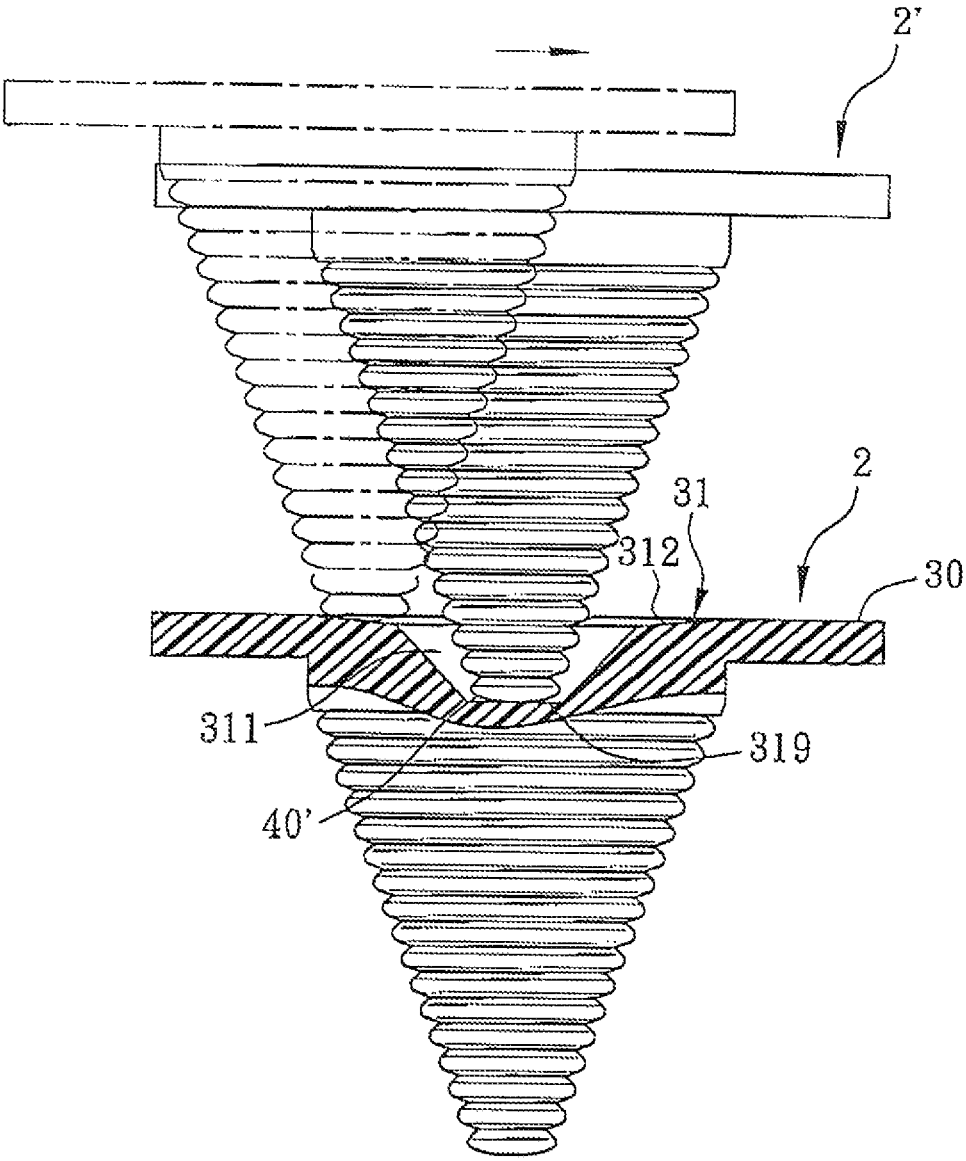
FIG. 6 is a partial sectional view of the first preferred embodiment, illustrating how two spinning tops may be stacked on top of each other while spinning.

Referring to FIG. 6, because the base portion 31 is formed with the central tapered groove 311 that tapers downward from the top face 30 of the plate body 3, and the diameter of the rotating tip end 40 is smaller than the smallest diameter of the central tapered groove 311, when the spinning top 2 is spinning, a second spinning top 2' may be whirled to the top face 30 of the spinning top 2, so that a rotating tip end 90' of the second spinning top 2' rotates within the central tapered groove 311 of the spinning top 2. Hence, the second spinning top 2' is stacked on top of the spinning top 2 while spinning simultaneously. It should be noted that through the presence of the slope area 312 that surrounds the central tapered groove 311, when the second spinning top 2' does not directly fall into the central tapered groove 311 but is within the slope area 312, the second spinning top 2' will continue to spin from the slope area 312 toward the direction of an arrow shown in FIG. 6 and into a bottom end 319 of the central tapered groove 311.

Figure 7:
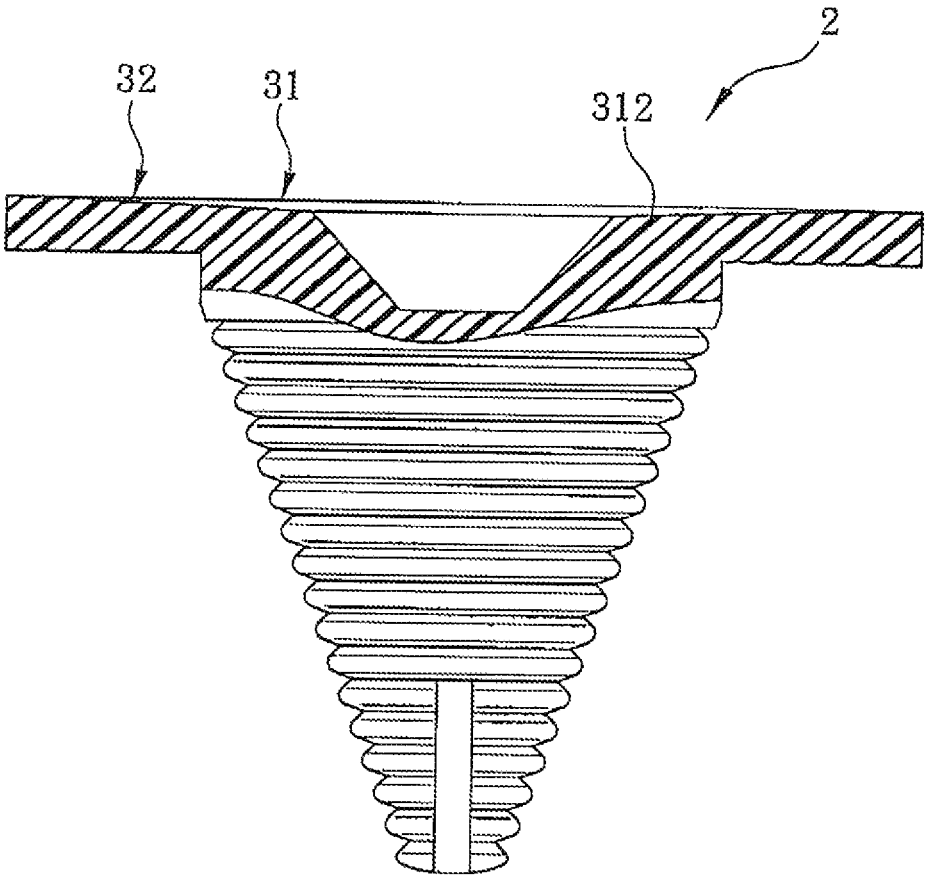
FIG. 7 is a view similar to FIG. 3, but illustrating an alternative form of a slope area of a plate body of the spinning top of the first preferred embodiment.

In this embodiment, the slope area 312 is formed on the base portion 31. Alternatively, as shown in FIG. 7, the slope area 312 may extend from the base portion 31 to the annular grip portion 32, so that the area of the slope area 312 may be enlarged to thereby enhance the rotational stability and success rate of a plurality of stacked spinning tops 2.

Figure 8:
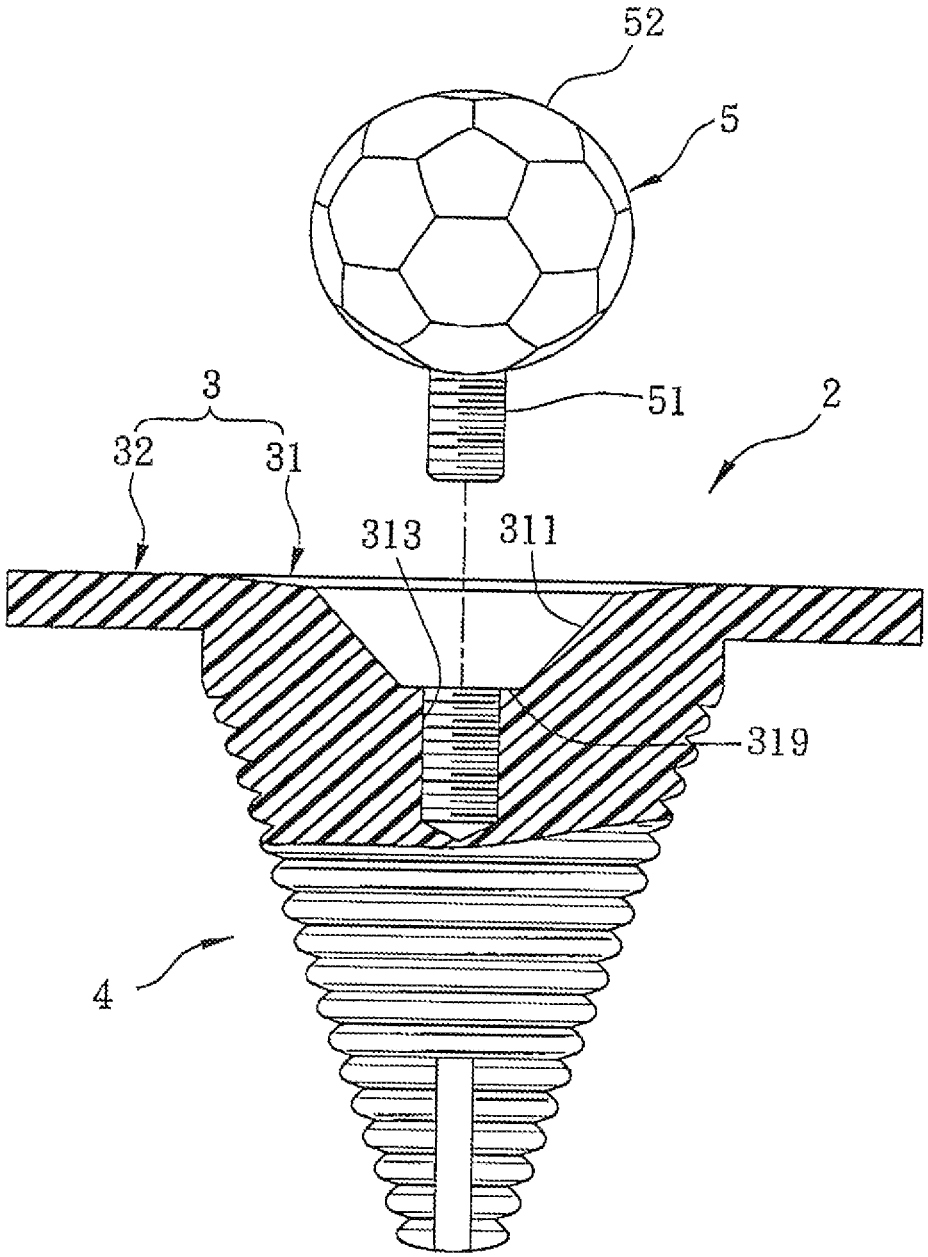
FIG. 8 is an exploded partial sectional view of a spinning top according to the second preferred embodiment of this invention.

Referring to FIG. 8, a spinning top 2 according to the second preferred embodiment of this invention is shown to be similar to the first preferred embodiment. However, in this embodiment, the base portion 31 further has an internally threaded connecting slot 313 extending downwardly from the bottom end 319 of the central tapered groove 311. The spinning top 2 further comprises a decorative element 5. The decorative element 5 has an externally threaded engaging portion 51, and a decorative portion 52 connected to the externally threaded engaging portion 51. When the externally threaded engaging portion 51 is engaged to the internally threaded connecting slot 313, the decorative portion 58 projects upwardly and outwardly from the plate body 3.

Through the aforesaid configuration, not only can the advantages described in the first preferred embodiment be achieved, but the configuration of the decorative portion 52 can also be altered according to the custom and tradition of each region or country. Taking for example Brazil, which is a football-loving country, the decorative portion 52 in FIG. 8 is configured as a football. When the plate body 3 and the main body 4 of the spinning top 2 rotates, the decorative portion 52 rotates therealong, thereby enhancing the entertainment and decorative effects of the spinning top 2. If the decorative element 5 is not required, a screw (not shown) may be engaged to the internally threaded connecting slot 313 to maintain the appearance of the spinning top 2 and to prevent dust and dirt from falling into the connecting slot 313.

Figure 9:
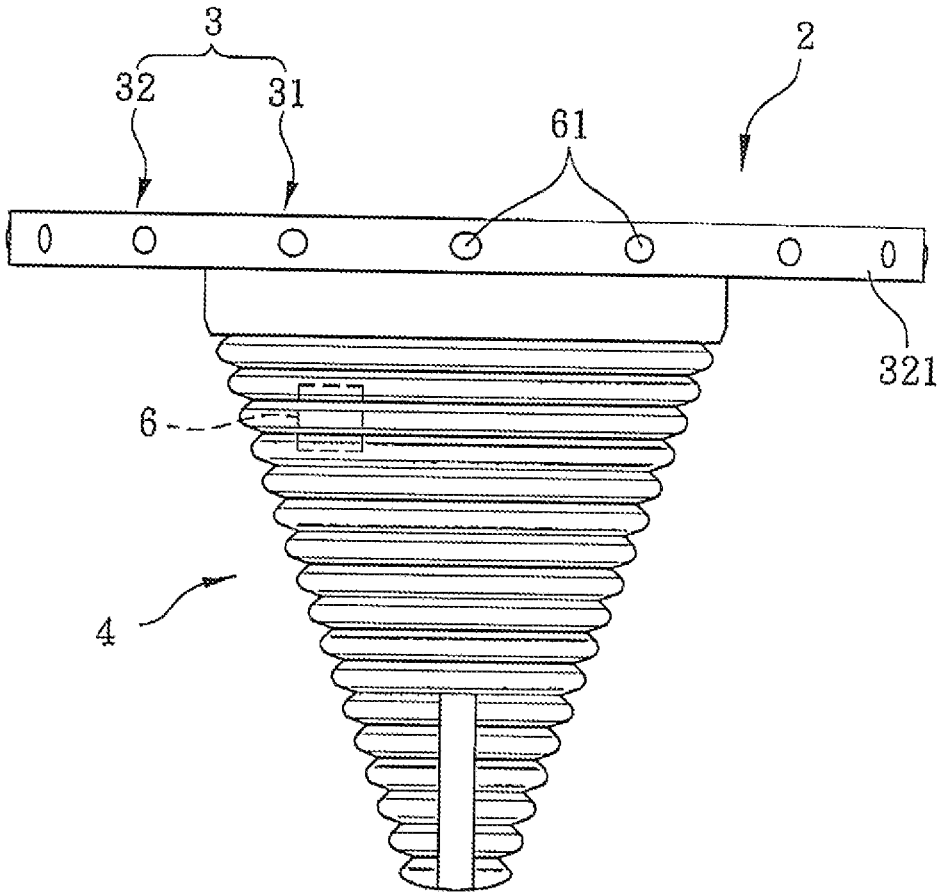
FIG. 9 is a schematic view of a spinning top according to the third preferred embodiment of this invention.

Referring to FIG. 9, a spinning top 2 according to the third preferred embodiment of this invention is shown to be similar to the first preferred embodiment. However, in this embodiment, the spinning top 2 further comprises a power supply 6, and a plurality of spaced-apart light-emitting elements 61 connected electrically to the power supply 6. In this embodiment, the power supply 6 is disposed in the main body 4. Alternatively, the power supply 6 may be disposed on a top or bottom face of the annular grip portion 32. As long as the counter weight and balance of the entire spinning top 2 is maintained, any suitable disposition of the power supply 6 is acceptable. The power supply 6 may be a lithium battery, an alkaline battery, or a carbon-zinc cell. When the power supply 6 is disposed on the top face of the grip portion 32, the power supply 6 may be configured as a solar power.

Figure 10:
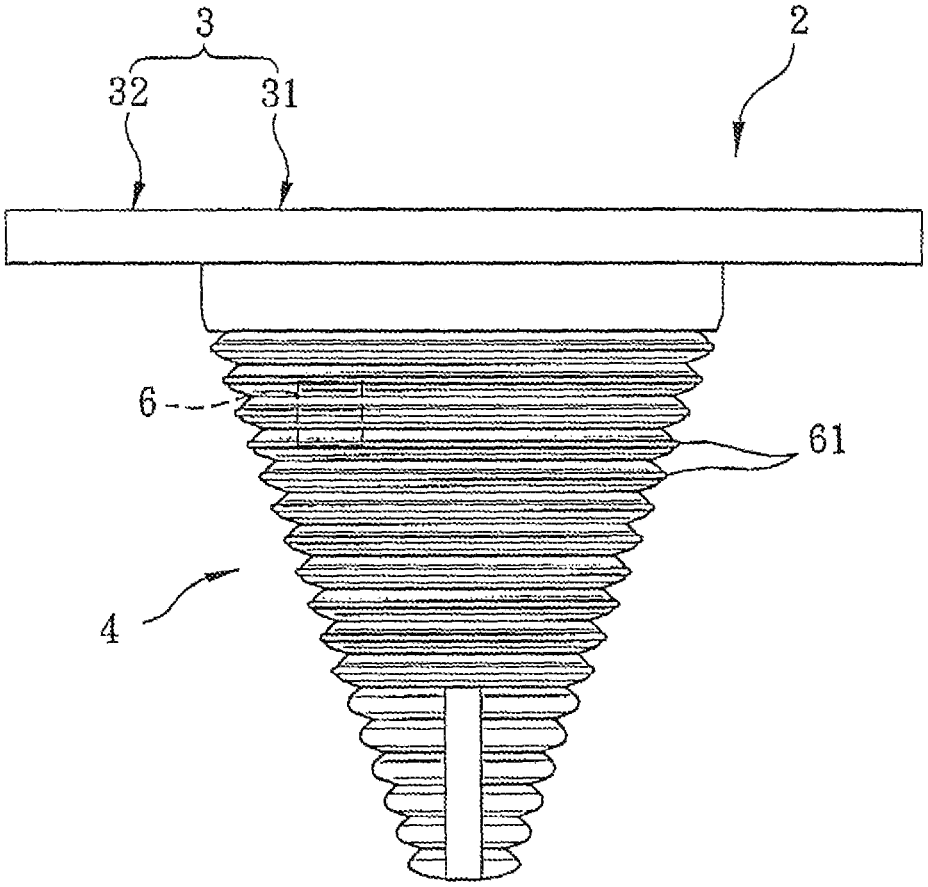
FIG. 10 is a view similar to FIG. 9, but illustrating an alternative form of a light-emitting element of the spinning top of the third preferred embodiment.

Further, in this embodiment, the light-emitting elements 61 are configured as light-emitting diodes (LEDs) disposed on a peripheral face 321 of the annular grip portion 32. Alternatively, the light-emitting elements 61 may be disposed on the top face of the grip portion 32 or an outer surface of the main body 4. As shown in FIG. 10, the light-emitting elements 61 may be in the form of fiber optic strip lights that surround the outer surface of the main body 4. The number of the light-emitting element 61 may be one, and is not limited to the disclosed embodiment. Since an electrical connection between the power supply 6 and the light-emitting elements 61 are known in the art, a detailed description thereof is dispensed herewith.

Hence, not only are the advantages described in the first preferred embodiment can be achieved, but also, in this embodiment, the spinning top 2 can emit light rays during rotation thereof, so that the spinning top 2 is lustrous and attractive. If the light-emitting elements 61 are multi-colored, during rotation of the spinning top 2, different light rays are mixed to produce a dazzling and moving visual effect.

Figure 11:
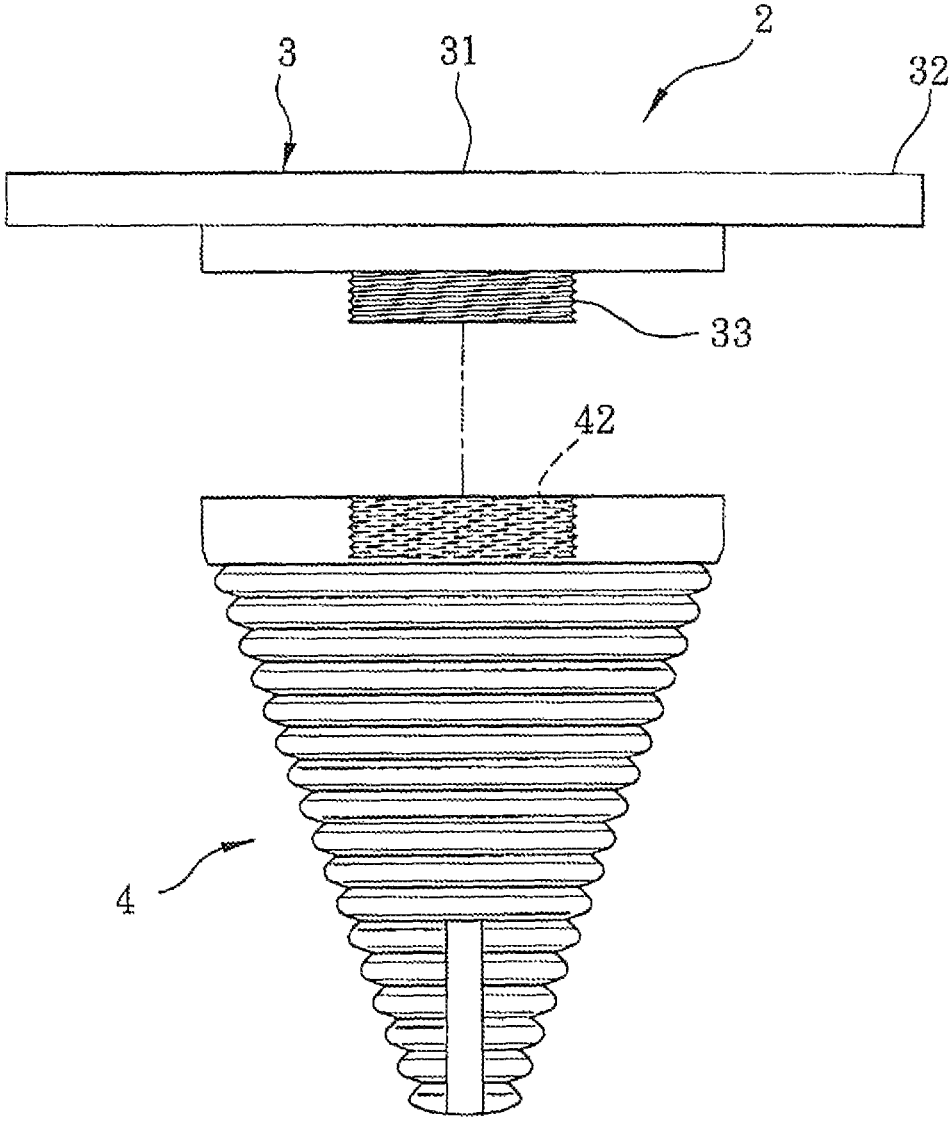
FIG. 11 is an exploded schematic view of a spinning top according to the fourth preferred embodiment of this invention.
Figure 12:
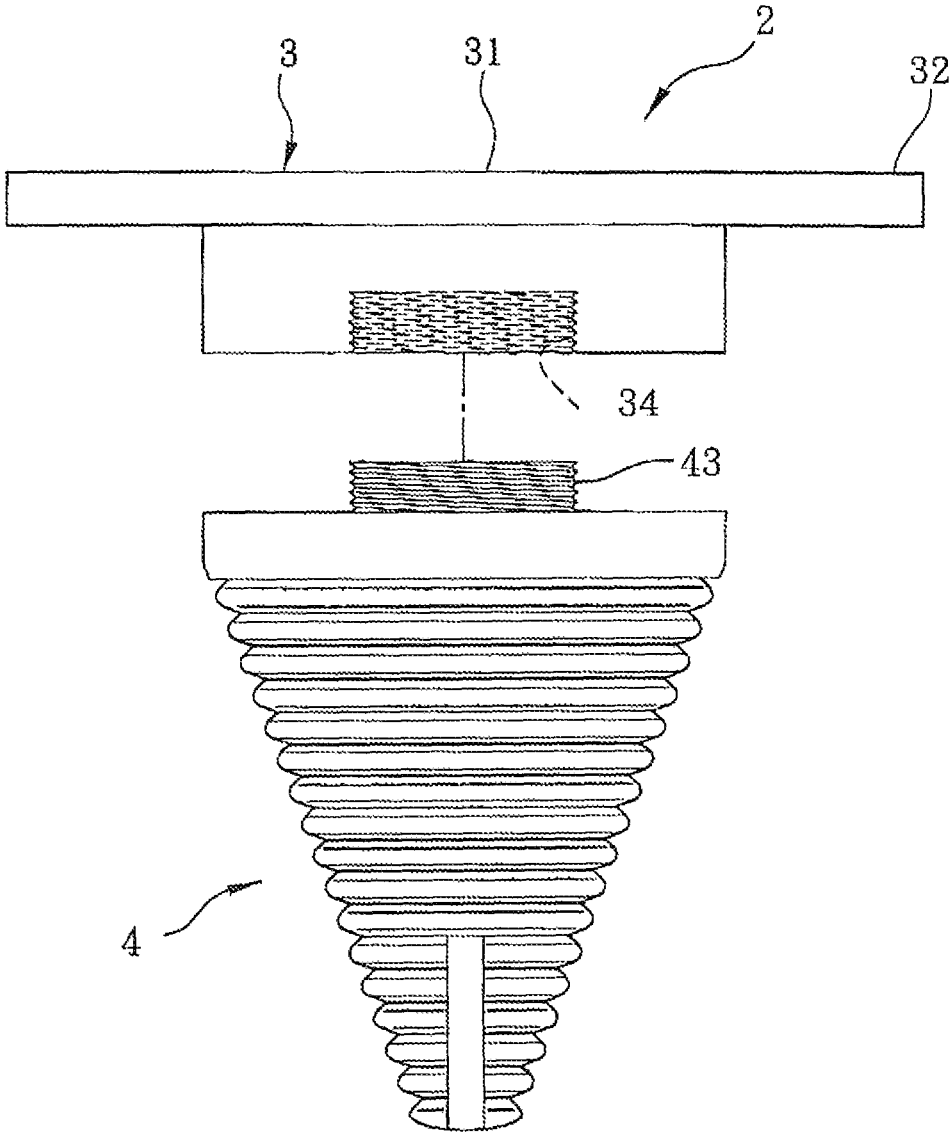
FIG. 12 is a view similar to FIG. 11, but illustrating an alternative form of the spinning top of the fourth preferred embodiment.

Referring to FIG. 11, a spinning top 2 according to the fourth preferred embodiment of this invention is shown to be similar to the first preferred embodiment. However, in this embodiment, the plate body 3 and the main body 4 are connected detachably to each other. The plate body 3 further includes an externally threaded protrusion 33 projecting downwardly from a bottom surface of the base portion 31. The main body 4 further has an internally threaded depression 42 to engage the externally threaded protrusion 33. Alternatively, as shown in FIG. 12, the plate body 3 may be formed with an internally threaded depression 34 formed in the bottom surface of the base portion 31, while the main body 4 may be formed with an externally threaded protrusion 43 projecting upwardly therefrom to engage the internally threaded depression 34. It should be noted that, in this embodiment, the thickness of the base portion 31 may be increased depending on the requirement, such that the thickness of the grip portion 32 is smaller than that of the base portion 31, and the gripping of the spinning top 2 by the user is not affected.

Through the aforesaid configuration, the plate body 3 may be altered to a different size according to the requirement, or when one of the plate body 3 and the main body 4 is damaged, said one of the plate body 3 and the main body 4 can be replaced with a new one. Hence, there is no need to throw away the spinning top 2 when a portion thereof is damaged.

In summary, the spinning top 2 of this invention has the annular grip portion 32 extending outwardly from the main body 4, so that gripping of the spinning top 2 is easy, a greater throwing force can be imparted, and the centrifugal force generated during spinning can be increased, thereby prolonging the spinning time of the spinning top 2. Further, through the configuration of the central tapered groove 311, a plurality of the spinning tops 2 can be stacked on top of each other while spinning simultaneously. Hence, the object of the present invention can be achieved.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A spinning top, comprising:

a main body tapering from a top end to a bottom end thereof and having a rotating tip end at said bottom end;

a plate body including a base portion connected to and covering said top end of said main body, an annular grip portion extending outwardly and radially from said base portion, and a top face defined by top surfaces of said base portion and said annular grip portion, said base portion having a central tapered groove tapering downwardly from said top face of said plate body, and an internally threaded connecting slot extending downwardly from a bottom end of said central tapered groove; and a decorative element having an externally threaded engaging portion to engage said internally threaded connecting slot, and a decorative portion connected to said externally threaded engaging portion;

wherein said rotating tip end has a diameter smaller than a smallest diameter of said central tapered groove.

2. The spinning top of claim 1, wherein said plate body further includes a slope area that surrounds said central tapered groove and that has an upper periphery directly connected to said top face of said plate body, and a lower periphery connected directly to a top periphery of said central tapered groove, said slope area being tapered from said upper periphery to said lower periphery.

3. The spinning top of claim 2, wherein said slope area is formed in said base portion.

4. The spinning top of claim 2, wherein said slope area extends from said base portion to said annular grip portion.

5. The spinning top of claim 1, wherein said main body further has a retaining flute extending upwardly from said rotating tip end for receiving one end of a pull cord.

6. A spinning top, comprising:

a main body tapering from a top end to a bottom end thereof and having a rotating tip end at said bottom end; and a plate body including a base portion connected to and covering said top end of said main body, an annular grip portion extending outwardly and radially from said base portion, and a top face defined by top surfaces of said base portion and said annular grip portion, said base portion having a central tapered groove tapering downwardly from said top face of said plate body;

wherein said rotating tip end has a diameter smaller than a smallest diameter of said central tapered groove;

wherein said plate body further includes an externally threaded protrusion projecting downwardly from a bottom surface of said base portion, and said main body further has an internally threaded depression detachably engaged with said externally threaded protrusion.

7. The spinning top of claim 1, wherein said grip portion has a thickness smaller than that of said base portion.

8. The spinning top of claim 6, wherein said plate body further includes a slope area that surrounds said central tapered groove and that has an upper periphery directly connected to said top face of said plate body, and a lower periphery connected directly to a top periphery of said central tapered groove, said slope area being tapered from said upper periphery to said lower periphery.

9. The spinning top of claim 8, wherein said slope area is formed in said base portion.

10. The spinning top of claim 8, wherein said slope area extends from said base portion to said annular grip portion.

11. The spinning top of claim 6, wherein said main body further has a retaining flute extending upwardly from said rotating tip end for receiving one end of a pull cord.

12. The spinning top of claim 6, wherein said grip portion has a thickness smaller than that of said base portion.

* * * * *